US006055887A

United States Patent [19]

Galat

[11] Patent Number: 6,055,887

[45] Date of Patent: May 2, 2000

[54] POWER-OPERATED WRENCH EXTENSION APPARATUS

[76] Inventor: Donald E. Galat, 1001 Badder Dr., Troy, Mich. 48083

[21] Appl. No.: 09/277,436

[22] Filed: Mar. 26, 1999

Related U.S. Application Data

[63] Continuation of application No. 08/966,730, Nov. 10, 1997, abandoned.

[51] Int. Cl.[7] ..... B25B 21/00

[52] U.S. Cl. ..... 81/57.13; 81/57.29; 81/177.2

[58] Field of Search ..... 81/54, 57, 57.11, 81/57.13, 57.29, 177.2

[56] References Cited

U.S. PATENT DOCUMENTS

| | | | |
|---|---|---|---|
| 2,808,749 | 10/1957 | Lampke | 81/57.13 |
| 3,430,510 | 3/1969 | Hendrikson | 81/57.29 |
| 4,803,904 | 2/1989 | Stanich et al. | 81/54 |
| 5,115,701 | 5/1992 | Lehnert | 81/57.13 |
| 5,345,845 | 9/1994 | Myers | 81/57.29 |
| 5,544,553 | 8/1996 | Galat | 81/57.13 |
| 5,577,425 | 11/1996 | Holmin et al. | 81/57.13 |
| 5,586,476 | 12/1996 | Wenner | 81/177.2 |
| 5,709,136 | 1/1998 | Frenkel | 81/57.29 |

*Primary Examiner*—David A. Scherbel
*Assistant Examiner*—Joni Danganan
*Attorney, Agent, or Firm*—Charles W. Chandler

[57] ABSTRACT

A power-operated wrench can be equipped with a wrench extension for access to bolts or nuts that are otherwise inaccessible. The wrench extension includes an elongated tubular housing rigidly secured to the wrench power unit for rotatably supporting a wrench extension drive shaft in a vibration-free operating mode. The tubular housing keeps the rotating shaft from vibrating in spite of reactive forces exerted by the bolt or nut on the wrench socket attached to the shaft.

3 Claims, 2 Drawing Sheets

POWER-OPERATED WRENCH EXTENSION APPARATUS

This application is a continuation of application Ser. No. 08/966,730, filed Nov. 10, 1997, (abandoned).

BACKGROUND OF THE INVENTION

This invention is related to a socket wrench extension accessory for a power-operated wrench, and more particularly to a power unit having a barrel-shaped housing for enclosing the socket wrench extension, and a bearing for supporting the outer end of the socket extension shaft in the housing.

Power-operated wrenches are commonly used in industrial applications for rotating a socket wrench. In many cases the workpiece is located such that the user must employ an extension shaft, usually several inches long, between the power unit and the socket. Conventionally, the power unit has a square rotary spindle that is received in one end of the socket extension shaft.

The opposite end of the wrench extension is connected to a fastening unit, such as a socket wrench.

There is usually considerable clearance between the conventional power unit square spindle and the square opening of the socket wrench extension.

Typically the power unit is pneumatically operated. The fastening process causes the tool to vibrate so violently that the connection between the power unit and the socket wrench extension progressively loosens. The increasing looseness increases the vibrations, causing considerable stress to the operator's body.

SUMMARY OF THE INVENTION

The broad purpose of the present invention is to provide an improved socket wrench extension for a power driven wrench assembly which reduces the vibrations incurred by the wrenching process, prolonging the life of the power unit bearings and reducing injury to workers who operate such devices.

A tubular or barrel shaped housing has one end threadably attached to the housing of the driving unit. The barrel-shaped housing encloses the wrench extension except for the shaft end which is accessible for mating with a wrench socket. A needle bearing is mounted in the housing adjacent its outer end and supports the wrench extension shaft. Thus, the outer end of the wrench shaft is supported for rotation, and reduces the vibrating load on the loose connection between the square spindle of the power unit, and the square socket of the wrench extension shaft.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views and in which:

FIG. 6 shows the FIG. 1 apparatus, with the wrench extension separated from the power drive unit.

DESCRIPTION OF THE PREFERRED EMBODIMENT

Figure 1:
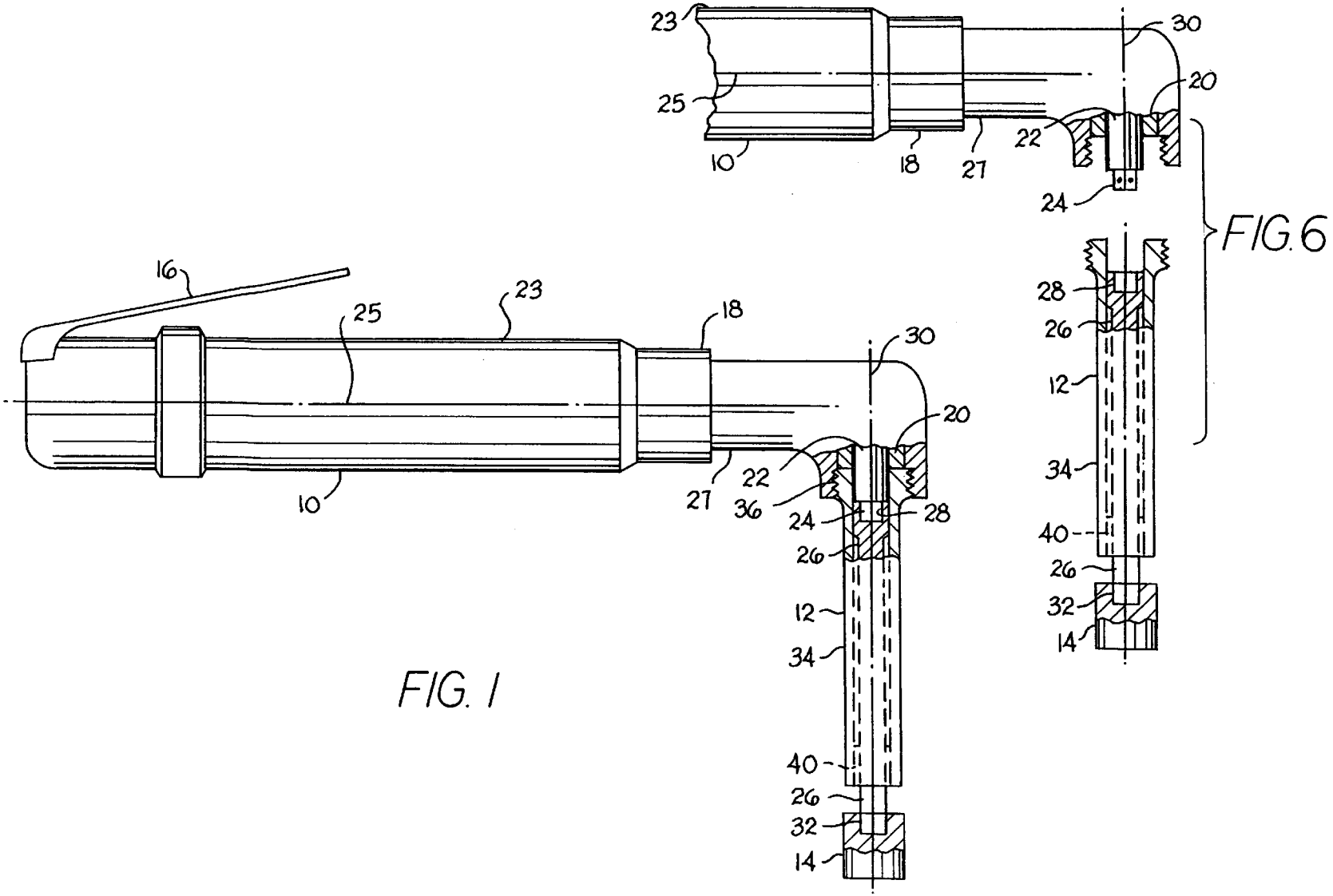
FIG. 1 is an elevational view of a power driven wrench apparatus illustrating the invention.

Referring to the drawings, FIG. 1 illustrates a pneumatic angle nutrunner type power drive unit 10 connected by a wrench extension 12 to a wrench socket 14. Power driven unit 10 is pneumatically driven and activated when a trigger 16 is squeezed by a user in the conventional manner. Drive unit 10 has a housing 18 with internal bearing means 20. Bearing means 20 support a spindle 22 having a non-circular square end 24 adapted to mate with a drive cavity in wrench socket 14. As shown in FIG. 1, wrench socket 14 is relocated from its normal position on square end 24 to a remote position on square end 32 of wrench extension 12 (which constitutes the present invention). Spindle 22 is rotated in the conventional manner when the trigger is squeezed.

As shown in FIG. 1, housing 18 comprises a main housing section 23 having a longitudinal axis 25, and a second housing section 27 having a transverse axis 30. The powered drive unit 10 is a right angle style device, wherein the rotary output member (spindle) 22 rotates on an axis that is at right angles to the principal axis of the main handle section 23.

The invention relates especially to the wrench extension 12 that includes a wrench extension drive shaft 26 and a tubular shaft support housing 34.

The wrench extension drive shaft 26 has one end with a square socket 28 which mates with square spindle 24 whereby shaft 26 rotates conjointly with spindle 22 about an axis 30. The square socket 28 is releasably coupled to the spindle and can be separated from the spindle by manual movement along axis 30. The opposite end of the wrench extension drive shaft has a square end 32 which may be coupled to a suitable fastener type accessory, such as a wrench socket.

Figure 2:
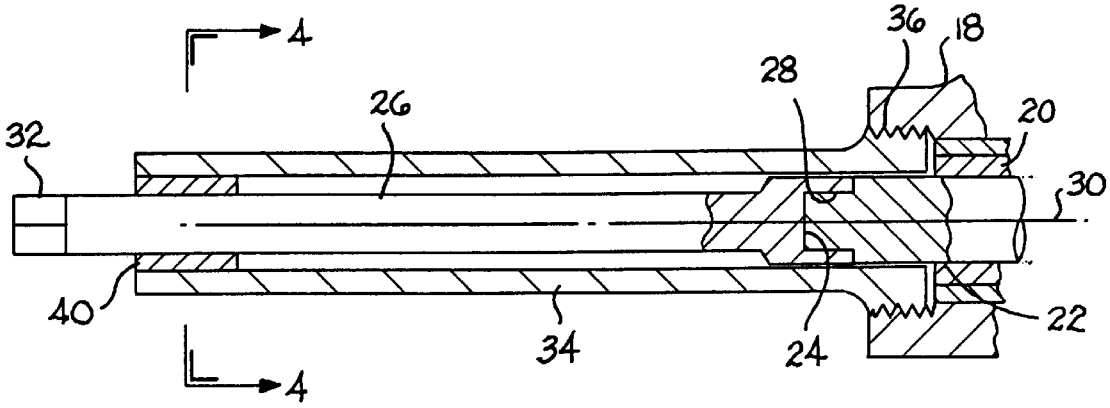
FIG. 2 is an enlarged sectional view through that portion of the wrench extension shaft housed within the barrel-shaped housing.
Figure 3:
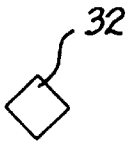
FIG. 3 is an end view of a drive shaft used in the FIG. 1 apparatus, as seen from the left end of FIG. 2.
Figure 4:
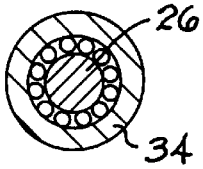
FIG. 4 is a view generally as seen along lines 4—4 of FIG. 2.
Figure 5:
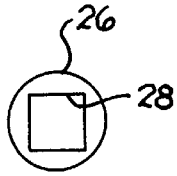
FIG. 5 is an end view of a drive shaft used in the FIG. 1 apparatus, as seen from the right end of the wrench extension, but with the shaft separated from the power driven unit

The wrench extension may have any suitable length. The barrel-shaped or tubular housing 34 has one end fixedly connected, as by threaded means 36, to power unit housing 18. Housing 34 has a longitudinal axis which coincides with the axis of rotation 30. Housing 34 has a uniform inner diameter that is greater than the diameter of the wrench extension drive shaft 26. The housing extends substantially the full length of the extension but permits access to square end 32. As shown in FIG. 2, square end 32 is located outside housing 34 so as to be visible for convenient insertion into the wrench socket 14 (as shown in FIG. 1).

Preferably a needle or ball bearing 40 is mounted in the outer end of the tubular housing 34 and supports the extension shaft. Bearing 40 is spaced from the square socket end of the extension. Consequently the inner end of the extension drive shaft 26 is supported on square spindle 24 and bearing means 20 adjacent the power unit 10. The outer end of the wrench extension shaft is supported by the bearing 40 adjacent the outer end of the tubular housing 34.

I have found that supporting the outer end of the wrench extension adjacent the square end 32 prolongs the life of the drive unit bearings, prolongs the life of the wrench extension, reduces the amount of vibration that is inherent in the wrenching operation and reduces the stress and wear and tear on the operator of the wrench.

Having described my invention, I claim:

1. A power-operated wrench assembly comprising:

a powered drive unit (10) having a drive unit housing (18) and a rotary output member (24) journalled in said housing for rotation about an axis (30); said rotary output member having a non-circular cross section adapted to mate with a wrench socket;

an extension drive shaft (26) having a first end that has a cross section telescopically fitting on said output member for conjoint rotation therewith; said extension drive shaft having a second end (32) remote from the drive unit housing; said second end having the same non-circular cross section as said output member, whereby said second end is adapted to mate with a wrench socket;

an elongated tubular shaft-support housing for said extension drive shaft; said shaft-support housing having a first end (at 36) telescopically connectable with said drive unit housing; said shaft support housing having a second end located between the first and second ends of said extension drive shaft, whereby the second end of said shaft is located outside of said shaft support housing;

a single anti-friction bearing means (40) mounted in said shaft support housing for rotatably supporting said drive shaft; said single anti-friction bearing means being located at said second end of said shaft support housing;

said first end of said drive shaft being supported solely by said rotary output member, whereby said shaft is rotatably supported jointly by said bearing means and said rotary output member;

said first end of said shaft support housing having a threadable connection with said drive unit housing, whereby said shaft support housing is a rigid extension of said drive unit housing; and said threadable connection being operable to rigidly secure said shaft support housing to said drive unit housing in spite of vibration generated in said drive shaft by reactive forces between the wrench socket and the nut or bolt being turned.

2. The power-operated wrench assembly of claim 1, wherein said drive unit housing comprises an elongated main housing section (23) having a first longitudinal axis (25), and an auxiliary housing section (27) having a second axis that is at right angles to said first longitudinal axis; said rotary output member being journalled in said auxiliary housing section for rotation about said second axis.

3. The power-operated wrench assembly of claim 1, wherein said removable connection comprises an internal thread means on said drive unit housing and a mating external thread means on said shaft support housing.

* * * * *